US012496633B1

(12) United States Patent
Bobel et al.

(10) Patent No.: US 12,496,633 B1
(45) Date of Patent: Dec. 16, 2025

(54) PUMP CONTROLLER FOR A SAND CASTING SYSTEM

(71) Applicant: GM GLOBAL TECHNOLOGY OPERATIONS LLC, Detroit, MI (US)

(72) Inventors: Andrew Clay Bobel, Troy, MI (US); John Patrick Spicer, Plymouth, MI (US); Debejyo Chakraborty, Novi, MI (US); Ryan Curtis Sekol, Grosse Pointe Woods, MI (US); Jorge F. Arinez, Rochester Hills, MI (US); Jeffrey A. Abell, Rochester Hills, MI (US); David C. Gillengerten, Defiance, OH (US); Qigui Wang, Rochester Hills, MI (US); Mary S. Boyd, Defiance, OH (US)

(73) Assignee: GM GLOBAL TECHNOLOGY OPERATIONS LLC, Detroit, MI (US)

( * ) Notice: Subject to any disclaimer, the term of this patent is extended or adjusted under 35 U.S.C. 154(b) by 0 days.

(21) Appl. No.: 18/783,745

(22) Filed: Jul. 25, 2024

(51) Int. Cl.

| | |
|---|---|
| ***B22D 39/00*** | (2006.01) |
| ***B22D 2/00*** | (2006.01) |
| *F04B 49/06* | (2006.01) |

(52) U.S. Cl.
CPC ..... *B22D 39/00* (2013.01); *B22D 2/00* (2013.01); *F04B 49/06* (2013.01)

(58) Field of Classification Search
CPC ..... B22D 39/00; B22D 2/00; B22D 17/30; B22D 17/32; B22D 18/00; B22D 18/08; B22D 35/00; B22D 35/04; B22D 39/003; B22D 39/006; B22D 39/04
See application file for complete search history.

(56) References Cited

U.S. PATENT DOCUMENTS

| | | | | |
|---|---|---|---|---|
| 12,085,070 | B2 | 9/2024 | Baechle et al. | |
| 2002/0020947 | A1* | 2/2002 | Takizawa | B22D 17/30 266/216 |
| 2020/0360988 | A1* | 11/2020 | Fontana | F27B 3/045 |

FOREIGN PATENT DOCUMENTS

| | | | |
|---|---|---|---|
| EP | 3946866 | B1 | 6/2023 |
| JP | 05077018 | A * | 3/1993 |

OTHER PUBLICATIONS

English Abstract of JP05077018A (Year: 1993).*
German Office Action from counterpart DE1020241271140, dated Oct. 28, 2024.

* cited by examiner

*Primary Examiner* — Keith Walker
*Assistant Examiner* — Steven S Ha

(57) ABSTRACT

A method for controlling a pump motor associated with a component molding system includes applying a selected activation energy to the pump motor, driving, with the pump motor, a casting medium from a source to a mold through a casting medium delivery system, delivering the casting medium into a mold cavity, detecting one or more casting medium delivery parameters in the casting medium delivery system, detecting one or more casting medium mold parameters in the mold cavity, sending a first plurality of signals representing the casting medium delivery parameters to a controller, sending a second plurality of signals representing the casting medium mold parameters to the controller, processing the first plurality of signals and the second plurality of signals to determine pump motor control parameters, and adjusting the selected activation energy to the pump motor based on the pump motor control parameters.

20 Claims, 3 Drawing Sheets

PUMP CONTROLLER FOR A SAND CASTING SYSTEM

INTRODUCTION

The information provided in this section is for the purpose of generally presenting the context of the disclosure. Work of the presently named inventors, to the extent it is described in this section, as well as aspects of the description that may not otherwise qualify as prior art at the time of filing, are neither expressly nor impliedly admitted as prior art against the present disclosure.

The present disclosure relates to the art of casting systems and, more particularly, to a pump controller for a sand casting system.

Various molding techniques have been used for centuries to produce parts, various articles, statues, and the like. Sand casting is a technique in which sand is compacted into a mold body. A depression or cavity having a desired shape is then formed in the sand. The depression or cavity represents a negative projection of the desired shape. In some cases, the mold is formed from two or more parts that are held together with clamps, fasteners, or the like.

Once the mold is prepared, a liquid is introduced into the cavity. Once the liquid hardens, the part is removed, checked, and put into service. The liquid may take on various forms including plastics, plasters, clays, and molten metal. In a production type setting, where multiple molds are being filled, often times a pump is used. The pump delivers the liquid from a storage container into the cavity.

SUMMARY

A method for controlling a pump motor associated with a component molding system, in accordance with the present disclosure, includes applying a selected activation energy to the pump motor, driving, with the pump motor, a casting medium from a source to a mold through a casting medium delivery system, delivering the casting medium into a mold cavity, detecting one or more casting medium delivery parameters in the casting medium delivery system, detecting one or more casting medium mold parameters in the mold cavity, sending a first plurality of signals representing the casting medium delivery parameters to a controller, sending a second plurality of signals representing the casting medium mold parameters to the controller, processing the first plurality of signals and the second plurality of signals to determine pump motor control parameters, and adjusting the selected activation energy to the pump motor based on the pump motor control parameters.

In other features, detecting one or more casting medium delivery parameters includes detecting a flow rate of the casting medium in a launder tube extending between the source to the mold.

In other features, detecting the flow rate includes sensing a change in a magnetic field passing through the casting medium.

In other features, sensing the change in a magnetic field includes passing the casting medium through an electromagnetic flow meter.

In other features, the method may include detecting a change in mass of the mold and sending signals representing the change in mass to the controller.

In other features, detecting the one or more casting medium delivery parameters includes sensing a height of casting medium in a mold inlet portion of the casting medium delivery system.

In other features, the method may include determining that the pump motor requires servicing based on the pump motor control parameters.

A system configured to control a pump motor for a casting system including a set of instructions, which, when executed by a computer, causes the casting system to, in accordance with the present disclosure apply a selected activation energy to the pump motor, drive, with the pump motor, a casting medium from a source to a mold through a casting medium delivery system, deliver the casting medium into a mold cavity, detect one or more casting medium delivery parameters in the casting medium delivery system, detect one or more casting medium mold parameters in the mold cavity, send a first plurality of signals representing the casting medium delivery parameters to a controller, send a second plurality of signals representing the casting medium mold parameters to the controller, process the first plurality of signals and the second plurality of signals to determine pump motor control parameters, and adjust the selected activation energy to the pump motor based on the pump motor control parameters.

In other features, the set of instructions, when executed by a computer, causes the casting system to detect a flow rate of the casting medium in a launder tube extending between the source to the mold when detecting the one or more casting medium delivery parameters.

In other features, the set of instructions, when executed by a computer, causes the casting system to sense a change in a magnetic field caused by the casting medium when detecting the flow rate.

In other features, the set of instructions, when executed by a computer, causes the casting system to pass the casting medium through an electromagnetic flow meter when sensing the change in magnetic field.

In other features, the set of instructions, when executed by a computer, further causes the casting system to detect a change in mass of the mold and send signals representing the change in mass to the controller.

In other features, the set of instructions, when executed by a computer, causes the casting system to sense a height of casting medium in a mold inlet portion of the casting medium delivery system with one of a conductivity sensor and a mechanical vibration transducer array when detecting the one or more casting medium delivery parameters.

In other features, the set of instructions, when executed by a computer, further causes the casting system to: determine that the pump motor requires servicing based on the pump motor control parameters.

A component casting system, in accordance with the present disclosure, includes a source of casting medium, a mold including a mold cavity, a casting medium delivery system connecting the source of casting medium and the mold cavity, a pump motor configured to motivate an amount of casting medium from the source of casting medium, through the casting medium delivery system, into the mold cavity, a plurality of sensors including at least one sensor configured to detect a parameter of the amount of casting medium in the casting medium delivery system and at least one sensor configured to detect a parameter of the amount of casting medium in the mold cavity, and a motor controller operatively connected to the pump motor and the plurality of sensors, the motor controller being configured to adjust a control parameter of the pump motor based on signals from one or more of the plurality of sensors.

In other features, one of the plurality of sensors includes a flow sensor that detects a rate of flow of the amount of casting medium through the casting medium delivery system.

In other features, the flow sensor comprises an electromagnetic flow sensor configured to detect a rate of flow of the amount of casting medium through the casting medium delivery system.

In other features, one of the plurality of sensors includes one or more temperature sensors arranged in the mold cavity.

In other features, the plurality of sensors includes one of a conductivity sensor and a mechanical vibration transducer array, the one of the conductivity sensor and the mechanical vibration transducer array being configured to detect a height of the amount of casting medium in the casting medium delivery system at an inlet to the mold cavity.

In other features, the motor controller determines an operational health factor of the pump motor.

Further areas of applicability of the present disclosure will become apparent from the detailed description, the claims and the drawings. The detailed description and specific examples are intended for purposes of illustration only and are not intended to limit the scope of the disclosure.

BRIEF DESCRIPTION OF THE DRAWINGS

The present disclosure will become more fully understood from the detailed description and the accompanying drawings, wherein.

In the drawings, reference numbers may be reused to identify similar and/or identical elements.

DETAILED DESCRIPTION

While casting systems constructed according to the present disclosure are described in the context of vehicle part manufacturing, the casting systems can be used in casting a wide array of components.

Casting vehicle components often involves pumping molten metals, such as aluminum, from a furnace to a mold fixture. The molten metal is pumped through conduits into a mold cavity. The mold cavity may include a sensor to determine when the molten metal has reached a selected level. The pump is driven by a motor that, based on input voltage, sets a selected flow rate for the molten metal. Over time, the pump may lose performance. At such a time, the input voltage does not result in the selected flow rate reaching the mold. Changes in the selected flow rate could lead to imperfections in the molded part. The imperfections cause the molded part to be wasted. Understanding, in real time, when a motor may be reaching a particular wear level will allow operators to make changes before the molded part is affected by improper casting.

Figure 1:
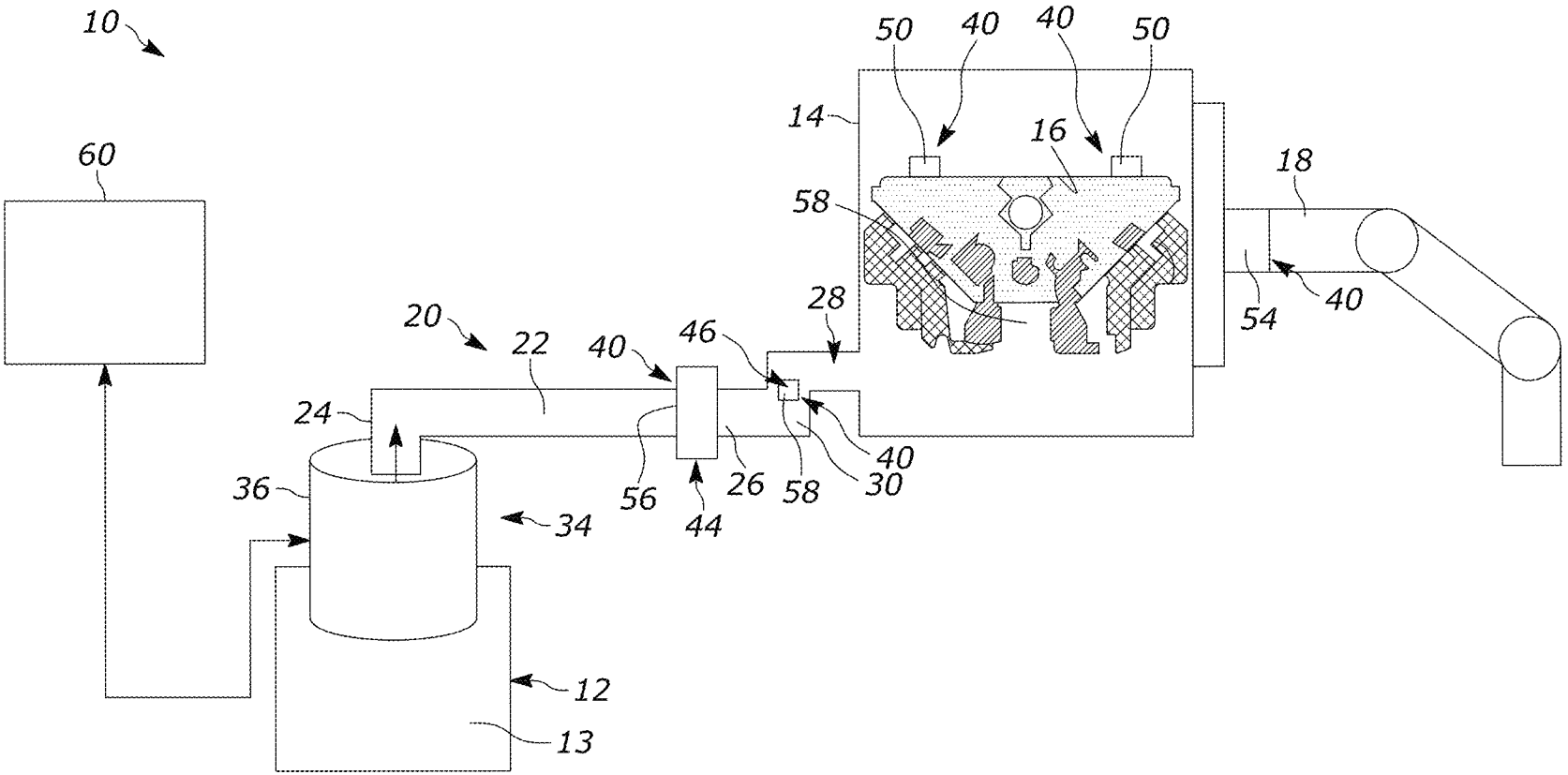
FIG. 1 is a schematic view of a sand casting system including a pump controller, in accordance with the present disclosure.

Referring to FIG. 1, a system for casting automobile components is indicated generally at 10. System 10 includes a source of casting medium 12 which may include a furnace 13 connected to a mold 14 having a mold cavity 16 in the shape of an automobile component such as an engine block. Mold 14 is connected to a support arm 18 that may be part of a component manipulation system or robot (not separately labeled). Source of casting medium 12 may contain a molten metal (also not separately labeled) such as iron, aluminum, and/or alloys thereof. The casting medium may take on various forms including both metals and non-metals.

Source of casting medium 12 is fluidically connected to mold 14 through a casting medium delivery system 20 including a launder tube 22. Launder tube 22 includes an inlet 24 fluidically connected to source of casting medium 12 and an outlet 26 fluidically connected to a mold fill tube 28. An elbow 30 acts as an interface between outlet 26 and mold fill tube 28. Outlet 26 delivers the casing medium into mold cavity 16 through elbow 30. A pump 34 is connected to inlet 24 of casting medium delivery system 20. Pump 34 drives the casting medium from source of casting medium 12 into mold cavity 16. In accordance with the present disclosure, pump 34 includes an electro-magnetic (E/M) pump motor 36. Of course, pump 34 may take on various configurations including mechanical pumps.

System 10 includes a plurality of sensors 40 that detect various parameters of the casting medium in casting medium delivery system 20 and mold 14. Plurality of sensors 40 include a flow sensor 44 arranged in launder tube 22, a height sensor 46 arranged at elbow 30, a number of temperature sensors 50 arranged in mold cavity 16, and a mass sensor 54 arranged at support arm 18. Mass sensor 54 may take on various configurations including force sensors and/or torque current monitoring of motors (not shown) arranged in support arm 18. In accordance with the present disclosure, flow sensor 44 takes the form of an electro-magnetic (E/M) flow sensor 56 that detects changes in a magnetic field induced by a flow of the casting medium through launder tube 22. That is, the casting medium flows through a static E/M field produced by E/M flow sensor 56 producing a readable voltage. Of course, E/M flow sensor may also produce an alternating E/M field.

Height sensor 46 takes the form of a mechanical vibration transducer array 58 including, for example, piezoelectric transducers (PZT) that receive vibration signatures from casting medium delivery system 20 to measure a height of casting medium in launder tube 22 and/or elbow 30. Of course, other sensors, such as conductivity sensors, may also be used to detect casting medium height in launder tube 22 and/or in elbow 30. As will be detailed more fully herein, E/M pump motor 36 and the plurality of sensors 40 are connected to a motor controller 60.

Figure 2:
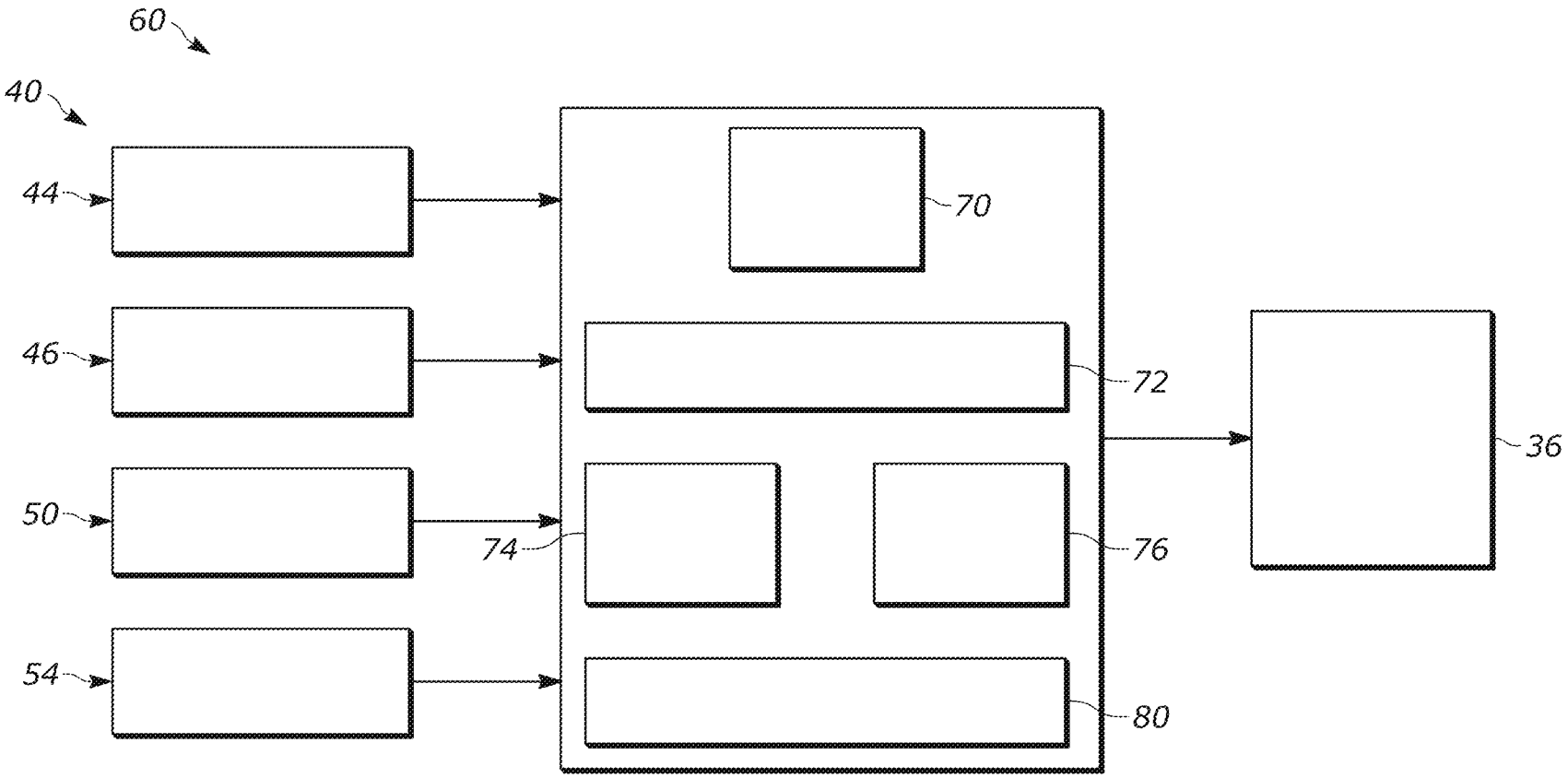
FIG. 2 is a block diagram illustrating the pump controller, in accordance with the present disclosure.

Referring to FIG. 2, motor controller 60 includes a central processing unit (CPU) 70 and a non-volatile memory 72. Motor controller 60 is further shown to include a sensor processing module 74, a motor prediction module 76, and a motor control module 80. At this point, it should be understood that while each component of motor controller 60 is shown as being co-located, other configurations, in which components are located in other portions of the system, are also contemplated. As will be detailed herein, motor controller 60 relies upon sensed parameters of the casting medium to control input voltage to E/M pump motor 36 to ensure a desired flow of casting medium into mold cavity 16. Motor controller 60 may also compare the signals from the plurality of sensors with data stored in non-volatile memory 72 to determine when E/M pump motor 36 may require maintenance.

Figure 3:
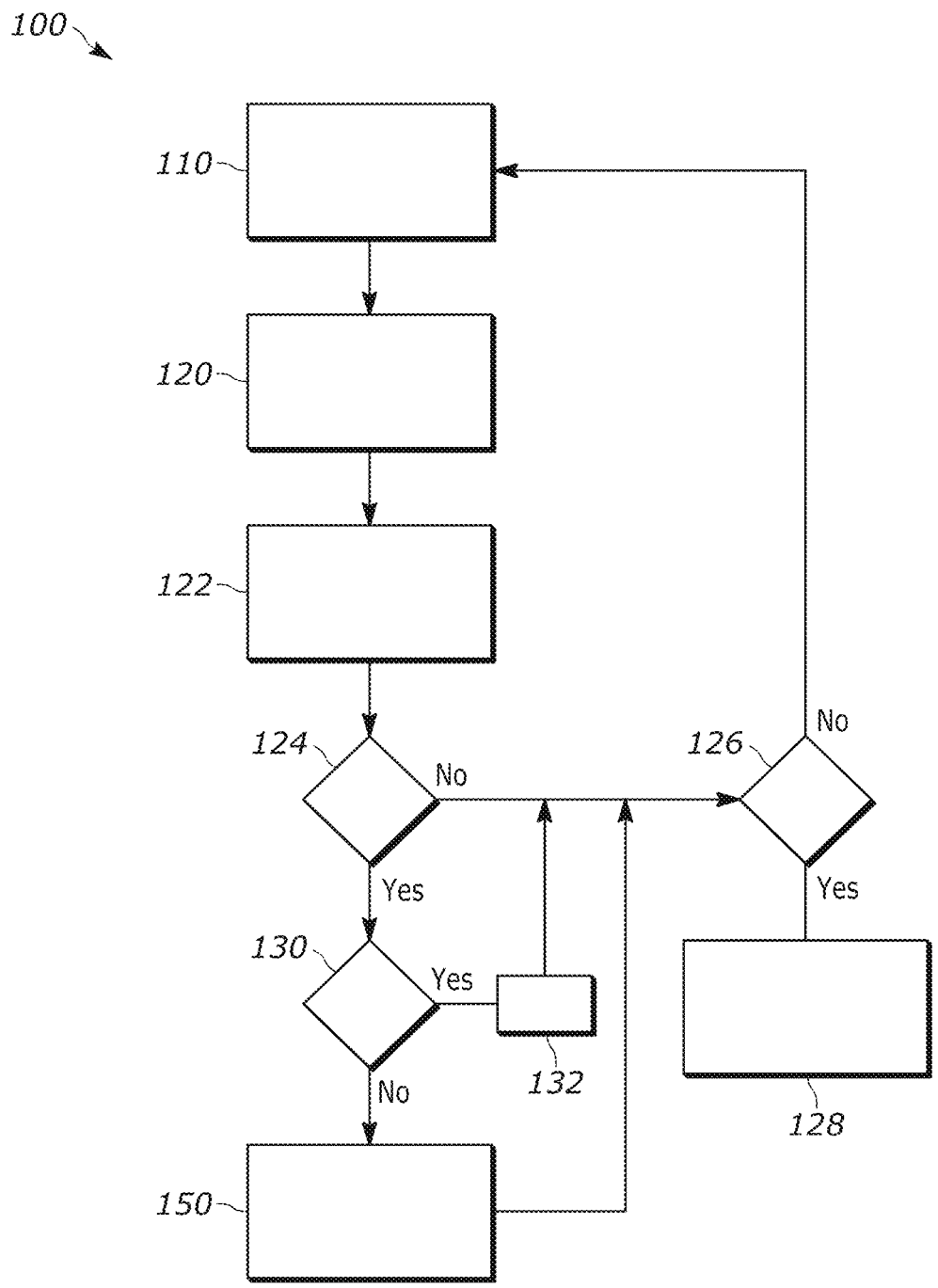
FIG. 3 is a flow chart illustrating a method of controlling a pump with the pump controller, in accordance with the present disclosure.

Reference will now follow to FIG. 3 in describing a method 100 of controlling E/M pump motor 36 and determining when a motor maintenance cycle is indicated. In block 110 a selected activation energy is applied to E/M pump motor 36. E/M pump motor 36 drives or impels the casting medium from source of casting medium 12 into mold 14 through casting medium delivery system 20. The casting medium flows, at a selected rate, from casting medium delivery system 20 into mold cavity 16 of mold 14. The selected flow rate ensures that mold cavity fills at a selected fill rate in order to minimize internal irregularities.

In block 120 plurality of sensors 40 detect casting medium delivery parameters such as flow rate, based on changes in the magnetic field in E/M flow sensor 56, and flow location, derived from signals passed from height sensor 46. In block 120 the plurality of sensors 40 also detect casting medium mold parameters, such as casting medium temperature, and casting medium location in various portions of mold cavity 16 through temperature sensors 50. Casting medium mold parameters also include detecting a change in mass of mold 14 derived from signals flowing from mass sensor 54.

In block 122 a first plurality of signals representing the casting medium delivery parameters is passed to sensor processing module 74. Also in block 122, a second plurality of signals representing the casting medium mold parameters is sent to sensor processing module 74. In block 124 the first plurality of signals and the second plurality of signals are processed by motor control module 80 and compared with data stored in non-volatile memory 72 to determine control parameters for E/M pump motor 36. If the comparison indicates that no changes are needed, e.g., flow rate, temperature changes, and mass changes are within desired parameters, the control parameters for E/M pump motor 36 remain unchanged. At this point, a determination is made, in block 126, whether mold cavity 16 is full. The determination that mold cavity 16 is full may be based on the change in mass, change in temperature, conductivity signals and/or combinations thereof. If mold cavity 16 is full, E/M pump motor is stopped in block 128 and mold 14 is changed. If mold cavity 16 is not full, method 100 returns to block 110 to continue the flow of casting medium.

If in block 124 a determination is made that the control parameters for E/M pump motor 36 require changing, e.g., flow rate, temperature changes, and/or mass changes are not within desired parameters, a determination is made in block 130 whether E/M pump motor 36 can be adjusted to the selected flow rate. That is, motor control module 80 compares data received from plurality of sensors 40 to adjustment data stored in non-volatile memory 72 and generates an operational health factor. If the operational health factor indicates that E/M pump motor 36 may be adjusted to return the flow rate to the desired parameters, the adjustment is made in block 132 and the process proceeds to block 126. The operational health factor describes an ability of the pump motor 36 to maintain a selected flow rate with a selected input current.

If, however the operational health factor determined on block 130 indicates that motor maintenance is needed based on, for example, control parameter change magnitude, control parameter change frequency and the like. A maintenance cycle is indicated, a maintenance alert is presented in block 150, and molding continues until the mold full signal is received. Based on the maintenance alert, operators will initiate a maintenance cycle after the "mold full" indication is derived in block 126. At that time, E/M pump motor 36 is removed from service and a new E/M pump is installed in block 150 and, due to the flow rate not being within selected parameters, the casting is flagged for a more detailed inspection.

At this point, it should be understood, that the systems and methods described in the present disclosure ensure that pump motors used to direct casting medium into a mold operate a peak performance and, when over time, the pump motor loses performance, that loss is identified quickly and before casting integrity is affected. As such, the number and frequency of mold imperfection is reduced along with component waste when poor castings occur. In addition to detecting pump motor wear, the plurality of sensors may be used to establish baseline operating conditions for each motor that may be tracked over time to more accurately predict when maintenance is going to be needed.

The foregoing description is merely illustrative in nature and is in no way intended to limit the disclosure, its application, or uses. The broad teachings of the disclosure can be implemented in a variety of forms. Therefore, while this disclosure includes particular examples, the true scope of the disclosure should not be so limited since other modifications will become apparent upon a study of the drawings, the specification, and the following claims. It should be understood that one or more steps within a method may be executed in different order (or concurrently) without altering the principles of the present disclosure. Further, although each of the embodiments is described above as having certain features, any one or more of those features described with respect to any embodiment of the disclosure can be implemented in and/or combined with features of any of the other embodiments, even if that combination is not explicitly described. In other words, the described embodiments are not mutually exclusive, and permutations of one or more embodiments with one another remain within the scope of this disclosure.

Spatial and functional relationships between elements (for example, between modules, circuit elements, semiconductor layers, etc.) are described using various terms, including "connected," "engaged," "coupled," "adjacent," "next to," "on top of," "above," "below," and "disposed." Unless explicitly described as being "direct," when a relationship between first and second elements is described in the above disclosure, that relationship can be a direct relationship where no other intervening elements are present between the first and second elements, but can also be an indirect relationship where one or more intervening elements are present (either spatially or functionally) between the first and second elements. As used herein, the phrase at least one of A, B, and C should be construed to mean a logical (A OR B OR C), using a non-exclusive logical OR, and should not be construed to mean "at least one of A, at least one of B, and at least one of C."

In the figures, the direction of an arrow, as indicated by the arrowhead, generally demonstrates the flow of information (such as data or instructions) that is of interest to the illustration. For example, when element A and element B exchange a variety of information, but information transmitted from element A to element B is relevant to the illustration, the arrow may point from element A to element B. This unidirectional arrow does not imply that no other information is transmitted from element B to element A. Further, for information sent from element A to element B, element B may send requests for, or receipt acknowledgements of, the information to element A.

In this application, including the definitions below, the term "module" or the term "controller" may be replaced with the term "circuit." The term "module" may refer to, be part of, or include: an Application Specific Integrated Circuit (ASIC); a digital, analog, or mixed analog/digital discrete circuit; a digital, analog, or mixed analog/digital integrated circuit; a combinational logic circuit; a field programmable gate array (FPGA); a processor circuit (shared, dedicated, or group) that executes code; a memory circuit (shared, dedicated, or group) that stores code executed by the processor circuit; other suitable hardware components that provide the described functionality; or a combination of some or all of the above, such as in a system-on-chip.

The module may include one or more interface circuits. In some examples, the interface circuits may include wired or wireless interfaces that are connected to a local area network (LAN), the Internet, a wide area network (WAN), or combinations thereof. The functionality of any given module of the present disclosure may be distributed among multiple modules that are connected via interface circuits. For example, multiple modules may allow load balancing. In a further example, a server (also known as remote, or cloud) module may accomplish some functionality on behalf of a client module.

The term code, as used above, may include software, firmware, and/or microcode, and may refer to programs, routines, functions, classes, data structures, and/or objects. The term shared processor circuit encompasses a single processor circuit that executes some or all code from multiple modules. The term group processor circuit encompasses a processor circuit that, in combination with additional processor circuits, executes some or all code from one or more modules. References to multiple processor circuits encompass multiple processor circuits on discrete dies, multiple processor circuits on a single die, multiple cores of a single processor circuit, multiple threads of a single processor circuit, or a combination of the above. The term shared memory circuit encompasses a single memory circuit that stores some or all code from multiple modules. The term group memory circuit encompasses a memory circuit that, in combination with additional memories, stores some or all code from one or more modules.

The term memory circuit is a subset of the term computer-readable medium. The term computer-readable medium, as used herein, does not encompass transitory electrical or electromagnetic signals propagating through a medium (such as on a carrier wave); the term computer-readable medium may therefore be considered tangible and non-transitory. Non-limiting examples of a non-transitory, tangible computer-readable medium are nonvolatile memory circuits (such as a flash memory circuit, an erasable programmable read-only memory circuit, or a mask read-only memory circuit), volatile memory circuits (such as a static random access memory circuit or a dynamic random access memory circuit), magnetic storage media (such as an analog or digital magnetic tape or a hard disk drive), and optical storage media (such as a CD, a DVD, or a Blu-ray Disc).

The apparatuses and methods described in this application may be partially or fully implemented by a special purpose computer created by configuring a general purpose computer to execute one or more particular functions embodied in computer programs. The functional blocks, flowchart components, and other elements described above serve as software specifications, which can be translated into the computer programs by the routine work of a skilled technician or programmer.

The computer programs include processor-executable instructions that are stored on at least one non-transitory, tangible computer-readable medium. The computer programs may also include or rely on stored data. The computer programs may encompass a basic input/output system (BIOS) that interacts with hardware of the special purpose computer, device drivers that interact with particular devices of the special purpose computer, one or more operating systems, user applications, background services, background applications, etc.

The computer programs may include: (i) descriptive text to be parsed, such as HTML (hypertext markup language), XML (extensible markup language), or JSON (JavaScript Object Notation) (ii) assembly code, (iii) object code generated from source code by a compiler, (iv) source code for execution by an interpreter, (v) source code for compilation and execution by a just-in-time compiler, etc. As examples only, source code may be written using syntax from languages including C, C++, C#, Objective-C, Swift, Haskell, Go, SQL, R, Lisp, Java®, Fortran, Perl, Pascal, Curl, OCaml, Javascript®, HTML5 (Hypertext Markup Language 5th revision), Ada, ASP (Active Server Pages), PHP (PHP: Hypertext Preprocessor), Scala, Eiffel, Smalltalk, Erlang, Ruby, Flash®, Visual Basic®, Lua, MATLAB, SIMULINK, and Python®.

What is claimed is:

1. A method for controlling a pump motor associated with a component molding system, the method comprising:

applying a selected activation energy to the pump motor;

driving, with the pump motor, a casting medium from a source to a mold through a casting medium delivery system;

delivering the casting medium into a mold cavity;

detecting one or more casting medium delivery parameters in the casting medium delivery system;

detecting one or more casting medium mold parameters in the mold cavity;

sending a first plurality of signals representing the one or more casting medium delivery parameters to a controller;

sending a second plurality of signals representing the one or more casting medium mold parameters to the controller;

processing the first plurality of signals and the second plurality of signals to determine pump motor control parameters;

adjusting the selected activation energy to the pump motor based on the pump motor control parameters;

determining an operational health factor of the pump motor, the operational health factor corresponding to an ability of the pump motor to maintain a selected flow rate when provided with a selected input current of the selected activation energy;

delivering the casting medium into the mold cavity after the operational health factor is determined until a mold full signal is received; and initiating a maintenance cycle on the pump motor based on the operational health factor.

2. The method of claim 1, wherein detecting the one or more casting medium delivery parameters includes detecting a flow rate of the casting medium in a launder tube extending between the source to the mold.

3. The method of claim 2, wherein detecting the flow rate includes sensing a change in a magnetic field passing through the casting medium.

4. The method of claim 3, wherein sensing the change in the magnetic field includes passing the casting medium through an electromagnetic flow meter.

5. The method of claim 1, further comprising:

detecting a change in mass of the mold; and sending signals representing the change in mass to the controller.

6. The method of claim 1, wherein detecting the one or more casting medium delivery parameters includes sensing a height of the casting medium in a mold inlet portion of the casting medium delivery system.

7. The method of claim 1, further comprising: determining that the pump motor requires servicing based on the pump motor control parameters.

8. The method of claim 1, further comprising presenting an alert indicating a need for pump motor maintenance based on the operational health factor.

9. A system configured to control a pump motor for a casting system, the system including a set of instructions, which, when executed by a computer, causes the casting system to:

apply a selected activation energy to the pump motor;

drive, with the pump motor, a casting medium from a source to a mold through a casting medium delivery system;

deliver the casting medium into a mold cavity;

detect one or more casting medium delivery parameters in the casting medium delivery system;

detect one or more casting medium mold parameters in the mold cavity;

send a first plurality of signals representing the one or more casting medium delivery parameters to a controller;

send a second plurality of signals representing the one or more casting medium mold parameters to the controller;

process the first plurality of signals and the second plurality of signals to determine pump motor control parameters;

adjust the selected activation energy to the pump motor based on the pump motor control parameters; and determine an operational health factor corresponding to an ability of the pump motor, the operational health factor establishes an ability of the pump motor to maintain a selected flow rate when provided with a selected input current of the selected activation energy;

deliver casting medium into the mold cavity after the operational health factor is determined until a mold full signal is received; and initiate a maintenance cycle on the pump motor based on the operational health factor.

10. The system of claim 9, wherein the set of instructions, when executed by a computer, causes the casting system to detect a flow rate of the casting medium in a launder tube extending between the source to the mold when detecting the one or more casting medium delivery parameters.

11. The system of claim 10, wherein the set of instructions, when executed by a computer, causes the casting system to sense a change in a magnetic field caused by the casting medium when detecting the flow rate.

12. The system of claim 11, wherein the set of instructions, when executed by a computer, causes the casting system to pass the casting medium through an electromagnetic flow meter when sensing the change in the magnetic field.

13. The system of claim 9, wherein the set of instructions, when executed by a computer, further causes the casting system to:

detect a change in mass of the mold; and send signals representing the change in mass to the controller.

14. The system of claim 9, wherein the set of instructions, when executed by a computer, causes the casting system to sense a height of the casting medium in a mold inlet portion of the casting medium delivery system with one of a conductivity sensor and a mechanical vibration transducer array when detecting the one or more casting medium delivery parameters.

15. The system of claim 9, wherein the set of instructions, when executed by a computer, further causes the casting system to: determine that the pump motor requires servicing based on the pump motor control parameters.

16. A component casting system comprising:

a source of casting medium;

a mold including a mold cavity;

a casting medium delivery system connecting the source of casting medium and the mold cavity;

a pump motor configured to motivate an amount of casting medium from the source of casting medium, through the casting medium delivery system, into the mold cavity;

a plurality of sensors including at least one sensor configured to detect a parameter of the amount of casting medium in the casting medium delivery system and at least one sensor configured to detect a parameter of the amount of casting medium in the mold cavity; and a motor controller operatively connected to the pump motor and the plurality of sensors, the motor controller being configured to adjust a selected control parameter of the pump motor based on signals from one or more of the plurality of sensors, wherein the motor controller is configured to determine an operational health factor of the pump motor indicative of an ability of the pump's motor to be adjusted to meet the selected control parameter and continue to operate the pump motor after the operational health factor indicates maintenance is needed until a maintenance cycle is initiated.

17. The component casting system according to claim 16, wherein one of the plurality of sensors includes a flow sensor that detects a rate of flow of the amount of casting medium through the casting medium delivery system.

18. The component casting system according to claim 17, wherein the flow sensor comprises an electromagnetic flow sensor configured to detect the rate of flow of the amount of casting medium through the casting medium delivery system.

19. The component casting system according to claim 16, wherein one of the plurality of sensors includes a temperature sensor arranged in the mold cavity.

20. The component casting system according to claim 16, wherein the plurality of sensors includes one of a conductivity sensor and a mechanical vibration transducer array, the one of the conductivity sensor and the mechanical vibration transducer array being configured to detect a height of the amount of the casting medium in the casting medium delivery system at an inlet to the mold cavity.

* * * * *